US005734628A

United States Patent [19]

Akasaka

[11] Patent Number: 5,734,628

[45] Date of Patent: Mar. 31, 1998

[54] WATCH DIAL PLATE STRUCTURE

[75] Inventor: Masayuki Akasaka, Ota-ku, Japan

[73] Assignee: Kabushiki Kaisha Hattori Seiko, Tokyo, Japan

[21] Appl. No.: 330,291

[22] Filed: Oct. 27, 1994

[30] Foreign Application Priority Data

Oct. 29, 1993 [JP] Japan ..... 5-272119

[51] Int. Cl.[6] ..... G04B 19/06

[52] U.S. Cl. ..... 368/232; 368/227

[58] Field of Search ..... 368/80, 223–239, 368/240–242

[56] References Cited

U.S. PATENT DOCUMENTS

| | | | |
|---|---|---|---|
| 3,908,355 | 9/1975 | Wiesner | 368/79 |
| 3,968,639 | 7/1976 | Beres et al. | 368/84 |
| 4,218,872 | 8/1980 | Ikegami . | |
| 4,247,930 | 1/1981 | Martin | 368/84 |
| 4,413,915 | 11/1983 | Besson | 368/71 |
| 4,435,046 | 3/1984 | Nishimura | 368/242 |
| 4,459,035 | 7/1984 | Nanya et al. | 368/241 |
| 4,488,818 | 12/1984 | Saurer et al. | 368/71 |
| 4,540,242 | 9/1985 | Shibuya et al. | 368/242 |
| 4,983,957 | 1/1991 | Ishikawa et al. | 340/785 |

FOREIGN PATENT DOCUMENTS

| | | |
|---|---|---|
| 57-073689 | 5/1982 | Japan . |
| 57-091483 | 6/1982 | Japan . |
| 2 060 236 | 4/1981 | United Kingdom . |

*Primary Examiner*—Bernard Roskoski
*Attorney, Agent, or Firm*—Stroock & Stroock & Lavan LLP

[57] ABSTRACT

A three-dimensional watch dial plate structure abundant in ornamental effect is provided fully utilizing the characteristics of an electro-optical display device such as a liquid crystal device or an electrochromic device. A color coat such as a white color and clear lacquer layer is laminated on a metal dial plate base. Successively laminated on the surface of a lower glass substrate are a lower transparent electrode layer, a lower electrochromic layer, a solid electrolyte layer, an upper electrochromic layer and an upper transparent electrode layer. The upper transparent electrode layer is formed on the back face of an upper glass substrate, and a transparent glass plate is bonded to the upper glass substrate. A metal hour scale and a metal minute scale each are formed on the surface of the transparent glass plate. The time scales are observed as suspended over the background of the color coat layer when the electrochromic device is uncolored, while they are observed on the background of the colored device when the device is colored.

10 Claims, 4 Drawing Sheets

WATCH DIAL PLATE STRUCTURE

BACKGROUND OF THE INVENTION

1. Field of the Invention

The present invention relates to a watch dial plate structure, and more particularly to a watch dial plate structure abundant in ornamental effect, using an electro-optical coloring thin film device such as an electrochromic device or a liquid crystal device.

2. Related Background Art

Watches have been increasing the ornamental effect as an important factor these days, and various watches abundant in ornamental effect have been developed. As for the ornamental effect of watches, a dial plate has a larger weight. For example, the metal surface of dial plate is engraved or patterned in a great variety.

To give a change to such plain decoration as described above, some recent watch dial plates have three-dimensional decoration utilizing an electro-optical coloring display device such as a liquid crystal device or an electrochromic device, as disclosed in Japanese Laid-open Utility Model Application No. 55-177690. The application discloses a watch display plate in which hands are indicated by a liquid crystal device and a three-dimensional pattern is engraved in the form of hands over the entire panel glass surface so that the hands look three-dimensional.

The electro-optical display device such as the liquid crystal device or the electrochromic device used in the above-described conventional watch time indication plate, however, was for indicating the hands themselves, so that a weight was placed on its function rather than the ornamental effect. Therefore, there were limitations of the ornamental effect.

SUMMARY OF THE INVENTION

It is, therefore, an object of the present invention to provide a watch dial plate structure abundant in three-dimensional ornamental effect, fully utilizing the characteristics of an electro-optical display device such as the liquid crystal device or the electrochromic device.

The above object of the present invention can be achieved by a first watch dial plate structure comprising:

- a metal dial plate base a surface of which is coated with a color coat;
- an electro-optical coloring thin film device located above the surface of the dial plate base and arranged to become colored or uncolored according to an electric signal; and
- a transparent glass plate located above the electro-optical coloring thin film device and having a time indication scale thereon.

Further, the above object of the present invention can also be achieved by a second watch dial plate structure comprising:

- a metal dial plate base having a time indication scale formed on a peripheral portion of a surface thereof; and
- an electro-optical coloring thin film device located in an area excluding the peripheral portion above the surface of the dial plate base and arranged as to become colored or uncolored according to an electric signal.

The first watch dial plate structure of the present invention shows such an indication that when the electro-optical coloring thin film device is in an uncolored state, the time indication scale on the transparent glass plate looks as suspended over the background of the dial plate base coated with the color coat.

When the electro-optical coloring thin film device is colored, the time indication scale on the transparent glass plate is shown over a different background color, providing an indication completely different in appearance from that in the uncolored state of the electro-optical coloring thin film device.

Since the transparent glass plate is located above the electro-optical coloring thin film device and the watch hands are above the transparent glass plate, the watch hands and time indication scale can be visually recognized clearly without being affected by the coloring of the electro-optical coloring thin film device.

Further, the second watch dial plate structure of the present invention is so arranged that the electro-optical coloring thin film device is placed in a region at least excluding the time indication scale on the surface of dial plate base. Accordingly, the time indication scale formed on the dial plate base can be always directly observed regardless of the colored state or the uncolored state of the electro-optical coloring thin film device.

When the electro-optical coloring thin film device is colored, the dial plate is locally colored, providing an indication completely different in appearance from that in the uncolored state of the electro-optical coloring thin film device.

BRIEF DESCRIPTION OF THE DRAWINGS

FIGS. 4A and 4B are front views to show a watch in which the watch dial plate structure of the first embodiment is incorporated, wherein FIG. 4A shows an uncolored state of the electrochromic device and FIG. 4B a colored state of the electrochromic device;

DESCRIPTION OF THE PREFERRED EMBODIMENTS

Embodiments of watch dial plate structure according to the present invention will be described with reference to FIG. 1 to FIG. 6B.

Figure 1:
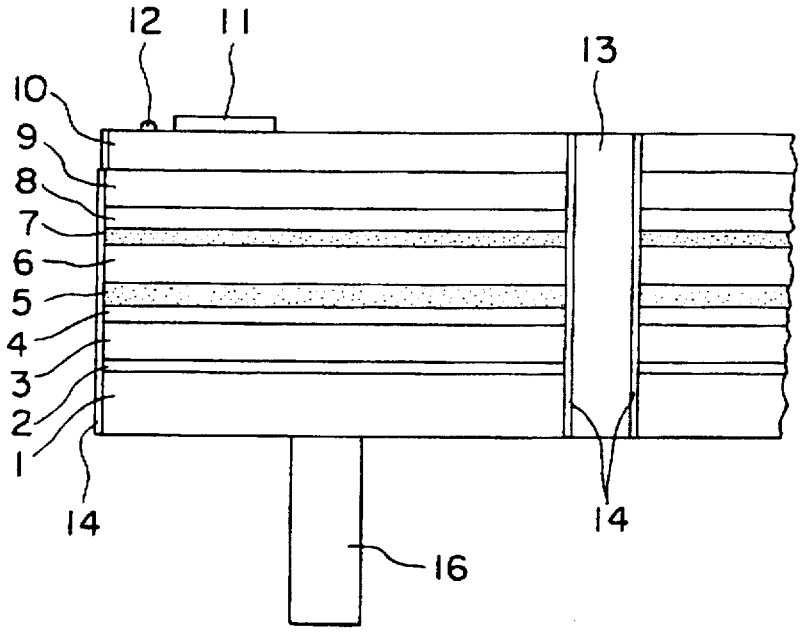
FIG. 1 is a cross-sectional view to show a first embodiment of watch dial plate structure according to the present invention.
Figure 2A:
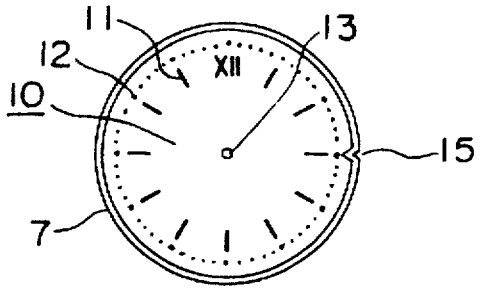
FIGS. 2A–2B exploded plan views to show constituent members in the watch dial plate structure of the first embodiment.
Figure 2B:
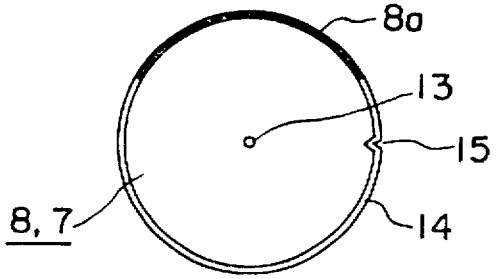
Figure 2C:
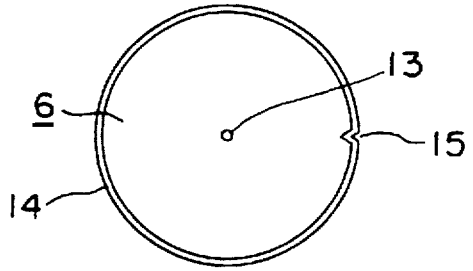
Figure 2D:
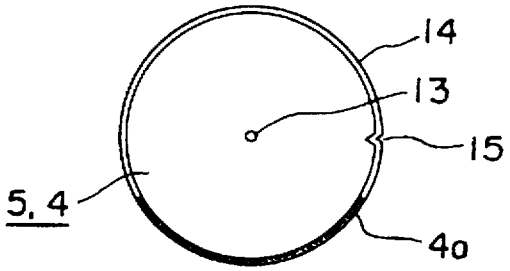
Figure 2E:
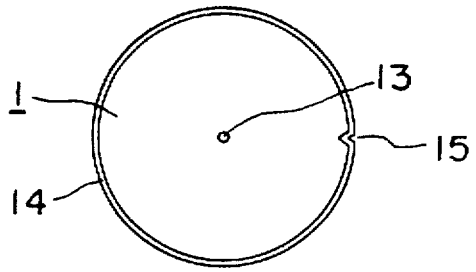
Figure 3:
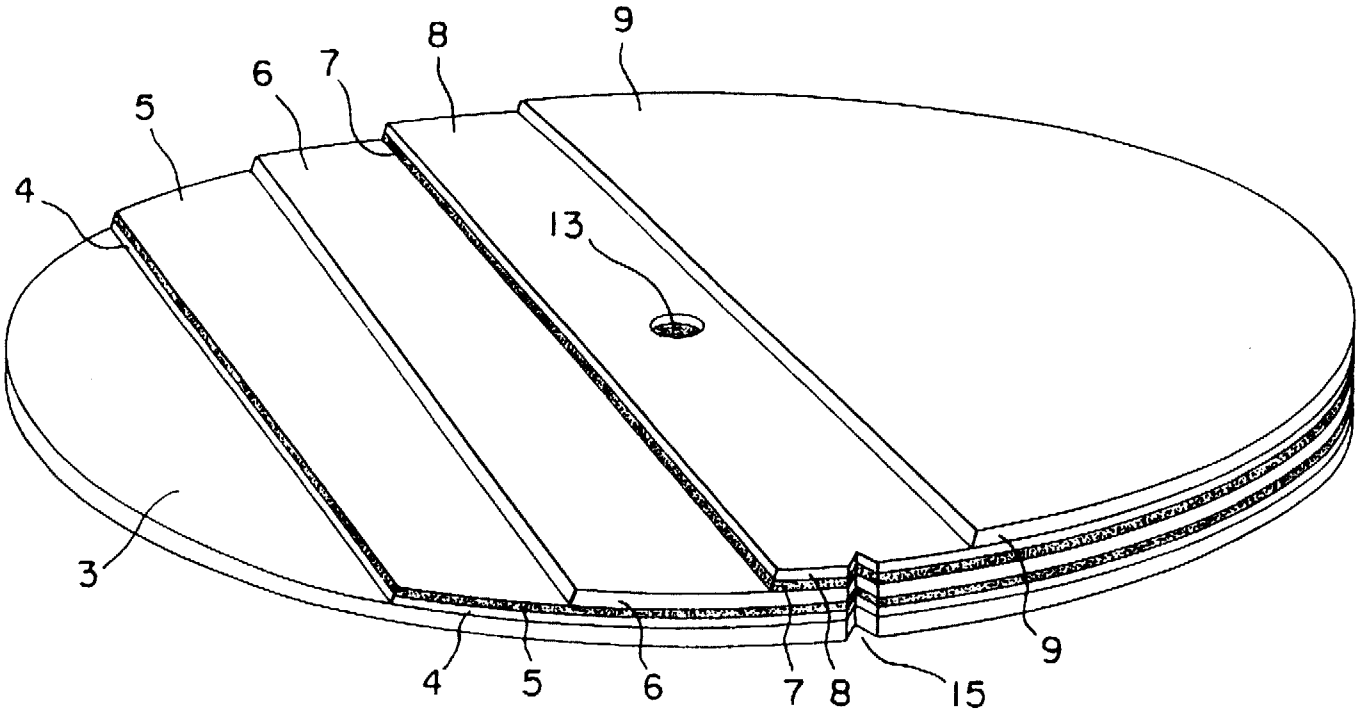
FIG. 3 is a perspective view, partly in section, to show the structure of an electrochromic device used in the watch dial plate structure of the first embodiment.

FIG. 1 to FIG. 3 show the first embodiment of the present invention, in which a dial plate base 1 is made of a metal such as brass and in which a color coat, e.g., a white coat, and a clear lacquer layer 2 is layered on the surface of dial plate base 1. The color coat and clear lacquer layer 2 is produced in such a manner that the color coat and the clear lacquer are successively applied onto the entire surface of dial plate base and the surface of clear lacquer layer is polished to become plane. A lower glass substrate 3 is bonded through an adhesive to the color coat and clear lacquer layer 2.

A lower transparent electrode layer 4 is layered on the upper surface, i.e., on the top surface of the lower glass substrate 3 by the thin film forming technology, for example by the vapor deposition. A lower electrochromic layer 5, a solid electrolyte layer 6 and an upper electrochromic layer 7 are successively laminated over the lower transparent electrode layer 4 by the thin film forming technology. An upper transparent electrode layer 8 is layered on the upper electrochromic layer 7, and the upper transparent electrode layer 8 is attached to a back surface of an upper glass substrate 9 by the thin film forming technology.

An electrochromic device is constituted by the lower transparent electrode layer 4, lower electrochromic layer 5, solid electrolyte layer 6, upper electrochromic layer 7 and upper transparent electrode layer 8. The electrochromic device 4–8 becomes colored in blue in accordance with an electric current signal applied to one transparent electrode layer 4 or 8, while it becomes uncolored in accordance with an electric current signal applied to the other transparent electrode layer 8 or 4. A coloring density is determined by an applying time of the electric current signal and the amplitude of the signal. When the electric current signal is interrupted in a colored state, the colored state is kept for a long time. FIG. 2B and FIG. 2D show a lead electrode 8*a* for the upper transparent electrode layer 8 and a lead electrode 4*a* for the lower transparent electrode layer 4, respectively.

A very thin transparent glass plate 10 with time scale is bonded to the upper glass substrate 9, and a metal hour scale 11 and a metal minute scale 12 are formed on the surface of the time-scale transparent glass plate 10. These hour scale 11 and minute scale 12 shine golden.

A through hole 13 is bored through the center from the dial plate base 1 to the transparent glass 10, and a watch hand shaft is set in the through hole 13. A dielectric coating 14 is given over the inner circumferential surface of the through hole 13 and the outer circumferential surface of the entire dial plate structure. Also, a positioning notch 15 is cut on the outer circumference of each of the dial plate base 1, the lower glass substrate 3, the upper glass substrate 9, and the transparent glass plate 10.

Dial plate legs 16 are provided to project from the back surface of dial plate base 1. The dial plate legs 16 are fixed on the watch main body not shown, whereby the dial plate base 1 is mounted on the watch main body. The thickness of the lamination of from the dial plate base 1 to the transparent glass 10 is determined to be approximately equal to that of ordinary dial plates.

Figure 4A:
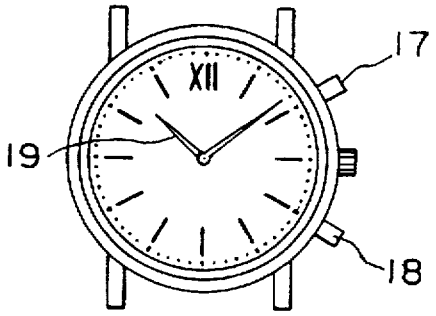
Figure 4B:
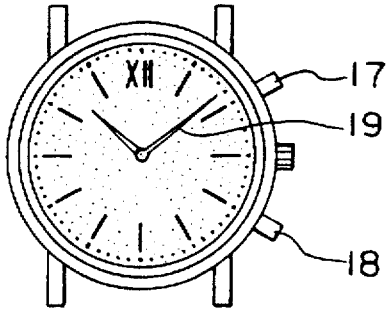

The dial plate structure as so arranged is incorporated in a watch, which has a coloring push button 17 and a color fading push button 18, as shown in FIGS. 4A and 4B. The electrochromic device 4–8 becomes colored when the coloring push button 17 is pressed, while it becomes uncolored when the color fading push button 18 is pressed.

The operation of the first embodiment is next described.

When the electrochromic device 4–8 is in an uncolored state, the hour scale 11 and minute scale 12 on the time scale transparent glass plate 10 are three-dimensionally observed as suspended and shining golden over the background of the color coat layer 2 on the dial plate base 1.

If the coloring push button 17 is depressed in this state for a certain time period, for example for ten seconds, the electrochromic device 4–8 becomes gradually colored in blue with sufficient density as shown in FIG. 4B. The coloring changes the background color behind the hour scale 11 and minute scale 12. That is, the time and minute scales are observed at high contrast over the background of dark blue electrochromic device 4–8. Thus, the indication in the colored state is completely different in appearance from that in the uncolored state of the electrochromic device 4–8. Such a colored state is kept for a long time unless the color fading push button 18 is depressed.

If one wants to stop the coloring of the electrochromic device 4–8, the electrochromic device 4–8 can return into the uncolored state by pressing the color fading push button 18 for a certain time, for example for about five seconds.

The coloring density of electrochromic device 4–8 can be adjusted by changing the pressing time of the coloring push button 17 or the pressing time of the color fading push button 18. Then, for example, if the coloring push button 17 is pressed for a relatively short time, the electrochromic device 4–8 becomes colored at low density or in a pale color, so that a synthetic color of the color coat layer 2 and the electrochromic device 4–8 can be observed.

The coloring of electrochromic device 4–8 is effective not only when the ornamental atmosphere of watch is desired to be changed, but also when the reflection of sun light from the color coat layer 2 is too bright. Further, since the scale transparent glass plate 10 is located above the electrochromic device 4–8 and the watch hands 19 are located above the scale transparent glass plate 10, as shown in FIGS. 4A and 4B, the watch hands 19 and the time indication scales 11, 12 can be always clearly visible without being affected by the coloring of electrochromic device 4–8.

The first embodiment as described above was so arranged that the hour scale 11 and minute scale 12 were formed on the time scale transparent glass plate 10 and the upper transparent electrode layer 8 was formed on the back face of the upper glass substrate 9. The present invention, however, is not limited to the above embodiment, but may be modified such that the transparent glass plate 10 and the upper glass substrate 9 are made integral as a single glass plate and that the hour scale 11 and minute scale 12 are formed on the top surface of the common glass plate while the upper transparent electrode layer 8 is on the back face thereof.

Figure 5A:
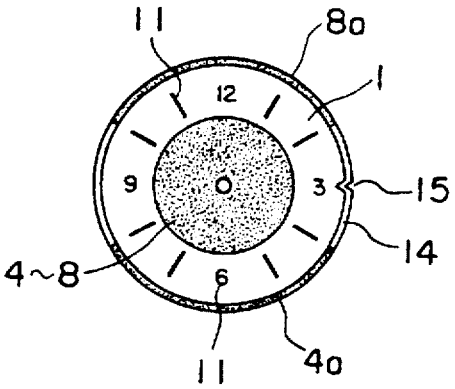
FIGS. 5A and 5B are front views to show a second embodiment of watch dial plate structure according to the present invention.

FIG. 5A shows the second embodiment of the present invention, in which a color coat such as a white coat is applied onto the surface of a metal dial plate base 1 and in which an hour scale 11 composed of numerals and lines is printed on a peripheral portion of the dial plate base 1 coated with the color coat. The dial plate base 1 with the hour scale 11 is coated with clear lacquer, and the clear lacquer surface is polished to be plane. Layered on the clear lacquer surface is an electrochromic device 4–8 as constructed in the same manner as the electrochromic device in the first embodiment. The electrochromic device 4–8 in the second embodiment is layered only in the central area, avoiding the peripheral portion of dial plate base 1 where the hour scale 11 is provided.

The electrochromic device 4–8 of such structure can be formed for example by laminating all layers 4–8 of from the lower transparent electrode layer 4 to the upper transparent electrode layer 8 only on the central area of dial plate base 1 as described, or by laminating the lower transparent electrode layer 4 and upper transparent electrode layer 8 only in the central area of dial plate base 1 and laminating the other layers of lower electrochromic layer 5, solid electrolyte layer 6 and upper electrochromic layer 7 over the entire surface of dial plate base 1.

Since the present embodiment is so arranged that the hour scale 11 is put on the dial plate base 1, the scale transparent glass plate 10 in the first embodiment can be obviated.

The electrochromic device 4–8 is located in the central area on the surface of dial plate base 1 as described, so that the hour scale 11 put on the peripheral portion of dial plate base 1 can be always directly observed irrespective of the colored state or the uncolored state of the electrochromic device 4–8.

When the electrochromic device 4–8 is colored, the dial plate is locally colored in the central area, presenting an indication completely different in appearance from that in the uncolored state of electrochromic device 4–8.

Figure 5B:
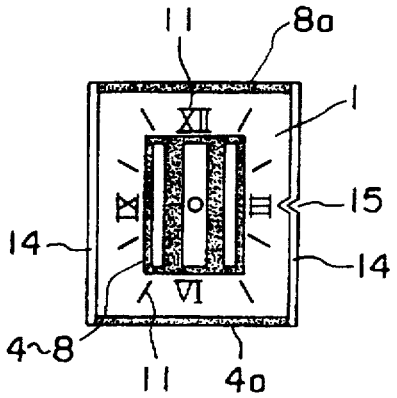

FIG. 5B shows a modification of the second embodiment, in which a dial plate base 1 is rectangular, an hour scale 11 is put on a peripheral portion of dial plate base, and an electrochromic device 4–8 is layered in a rectangular central area surrounded by the peripheral portion. The electrochromic device 4–8 is formed in a pattern of belts. The other arrangement is the same as that in FIG. 4A.

Figure 6A:
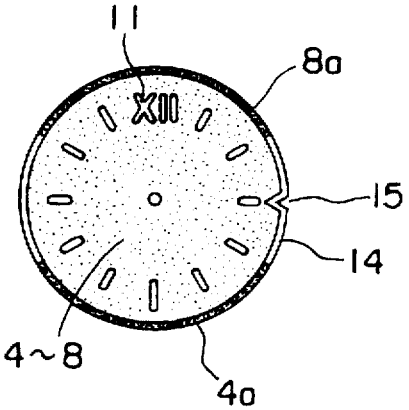
FIGS. 6A and 6B are front views to show a third embodiment of watch dial plate structure according to the present invention.

FIG. 6A shows the third embodiment of the present invention, in which an hour scale 11 composed of numerals and lines is solid-printed or trim-printed in a peripheral portion of surface of a metal dial plate base in the same manner as in the second embodiment. The electrochromic device 4–8 is layered over the entire area excluding the region of the hour scale 11 on the dial plate base surface.

When the electrochromic device 4–8 is in the uncolored state, the entire surface of dial plate base 1 can be observed. When the electrochromic device 4–8 is colored, portions except for the hour scale 11 are colored as shown in FIG. 6A. Thus, the hour scale 11 can be observed through the spacings in the colored electrochromic device 4–8.

Figure 6B:
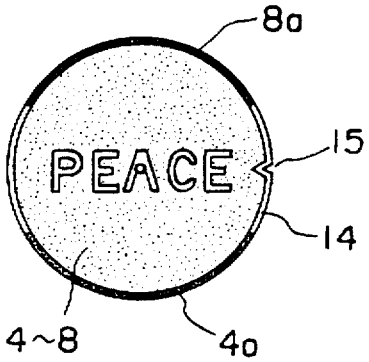

FIG. 6B shows a modification of the third embodiment, in which an electrochromic device 4–8 is formed in such a pattern that it can indicate a message such as "PEACE" in the colored state. The other arrangement is the same as that in the third embodiment.

If the above first to third embodiments are so arranged that a phosphorescence-maintaining luminous agent is painted on the coat surface of hour scale 11 on the dial plate base 1 or that a phosphorescence-maintaining luminous agent is painted instead of the coat applied onto the dial plate base 1, an ornamental effect further different in appearance can be attained.

The above embodiments employed the full-solid-type electrochromic device as the electro-optical coloring thin film device. The present invention, however, is not limited to it, but may also be applied to applications with other types of electrochromic devices, liquid crystal devices or any devices as long as they can change the colored state by an electric signal.

As seen from the above description, the present invention can provide a watch dial plate structure being three-dimensional and abundant in ornamental effect, in such an arrangement that the time indication scale on the transparent glass plate can be observed as suspended over the background of dial plate base coated with the color coat when the electro-optical coloring thin film device is in the uncolored state but that when the electro-optical coloring thin film device is in the colored state, the background color is continuously changed to present an indication completely different in appearance from that in the uncolored state of electro-optical coloring thin film device.

Further, the watch hands and time indication scale can be clearly visible without being affected by the coloring of electro-optical coloring thin film device.

In another aspect of the present invention, the electro-optical coloring thin film device is located in an area at least excluding the time indication scale on the dial plate base surface, so that the time indication scale formed on the dial plate base can be always directly observed irrespective of the colored state or the uncolored state of electro-optical coloring thin film device.

When the electro-optical coloring thin film device is colored, the dial plate is locally colored, presenting an indication completely different in appearance from that in the uncolored state of electro-optical coloring thin film device.

What is claimed is:

1. A watch dial plate structure comprising:

a metal dial plate base, a surface of which is coated with a color coat;

an electrochromic device located above said surface of said dial plate base, said electrochromic device selectively exhibiting one of a plurality of color states representing a range of densities of a color or an uncolored transparent state, a coloring selector and a fading selector for selectively applying an electric signal to said electrochromic device to cause its exhibited color density to uniformly vary from and between said uncolored transparent state represented by a minimum color density and a color state represented by a maximum color density corresponding to opaqueness, according to said electric signal;

said electrochromic device comprising an upper transparent electrode layer, a lower electrode layer and at least one electrochromic layer disposed therebetween; and a transparent plate located above said electrochromic device having a time indication scale on a portion thereof.

2. A watch dial plate structure according to claim 1, wherein said electrochromic device is formed below a portion of the transparent glass plate that does not include the time indication scale.

3. A watch dial plate structure according to claim 1, wherein said electrochromic device is formed in a predetermined pattern.

4. A watch dial plate structure according to claim 1, wherein said electrochromic device is formed above the entire surface of the dial plate base.

5. A watch dial plate structure according to claim 1, wherein said electrochromic device indicates a predetermined character when colored.

6. A watch dial plate structure according to claim 1, wherein said electrochromic device becomes colored when a voltage is applied to one of said electrode layers and uncolored when a voltage is applied to the other of said electrode layers.

7. A watch dial plate structure according claim 1, including a lower electrochromic layer formed on the lower electrode layer, a solid electrolyte layer on said lower electrochromic layer, and an upper electrochromic layer on said solid electrolyte layer.

8. A watch dial plate structure according to claim 6, wherein said lower electrode layer is transparent.

9. A watch dial plate structure according claim 7, wherein said lower electrode layer is transparent.

10. A watch dial plate structure according to claim 1, wherein said coloring selector and color fading selector control said electric signal, said electric signal being selectively applied by selecting either said coloring selector or said color fading selector.

* * * * *